US006087607A

United States Patent [19]

Dohnal et al.

[11] Patent Number: 6,087,607

[45] Date of Patent: Jul. 11, 2000

[54] POSITION SIGNALLING DEVICE

[75] Inventors: Dieter Dohnal, Lappersdorf; Josef Neumeyer, Deuerling, both of Germany

[73] Assignee: Maschinenfabrik Reinhausen GmbH, Regensburg, Germany

[21] Appl. No.: 09/308,480

[22] PCT Filed: Jan. 9, 1998

[86] PCT No.: PCT/EP98/00093

§ 371 Date: May 17, 1999

§ 102(e) Date: May 17, 1999

[87] PCT Pub. No.: WO98/36435

PCT Pub. Date: Aug. 20, 1998

[30] Foreign Application Priority Data

Feb. 14, 1997 [DE] Germany ..... 197 05 576

[51] Int. Cl.[7] ..... H01H 3/42

[52] U.S. Cl. ..... 200/574; 200/11 TC

[58] Field of Search ..... 200/11 TC, 24, 200/574

[56] References Cited

U.S. PATENT DOCUMENTS

| | | | |
|---|---|---|---|
| 2,560,002 | 7/1951 | Sealey | 175/375 |
| 3,204,049 | 8/1965 | Norman | 200/11 |

FOREIGN PATENT DOCUMENTS

| | | |
|---|---|---|
| 2025491 | 9/1970 | France . |
| 1 812 609 | 6/1970 | Germany . |
| 2 108 013 | 9/1972 | Germany . |
| 29 47 343 C2 | 5/1981 | Germany . |

*Primary Examiner*—Lincoln Donovan
*Assistant Examiner*—Nhung Nguyen
*Attorney, Agent, or Firm*—Herbert Dubno; Andrew Wilford

[57] ABSTRACT

The invention relate to a position signaling layout for a motor drive which also serves to activate an on-load tap changer, an off-circuit tap changer or a plunger core coil. Position signaling devices of this kind detect the position at a given time of the on-load tap changer or similar and transmit this information in the form of an electric signal. According to the invention, the device consists essentially of a board on which there are fixed signaling contacts and a pivoted cam disc which connects said fixed contacts electrically and links them to a terminal lead via a spring operated switch, activating the spring operated switch by means of its front cam contour.

10 Claims, 2 Drawing Sheets

POSITION SIGNALLING DEVICE

CROSS REFERENCE TO RELATED APPLICATIONS

This application is the US national phase of PCT application PCT/EP98/00093 filed Jan. 9, 1998 with a claim to the priority of German application 197 05 576.1 filed Feb. 14, 1997.

FIELD OF THE INVENTION

The invention relates to a position-signaling apparatus for a motor drive of an on-load tap changer, an off-load tap changer, or a movable-core coil according to the characterizing clause of the first claim. Such a position-signaling apparatus is known from German 2,108,013.

BACKGROUND OF THE INVENTION

On-load tap changers make it is possible to change the taps of windings of a step transformer under load without interrupting current flow. Off-load tap changers facilitate the switchover between winding taps of a step transformer when not under load. Movable-core coils allow impedance to be changed or adjusted.

Position-signaling apparatuses functioning as part of the motor drives of on-load tap changers or the like serve to determine the current position of the on-load tap changer or the like and to output this position; this is in turn the starting point for the—normally optical—display of the position and is also usable as an actual value for subsequent control functions.

Known position-signaling apparatuses for on-load tap changers comprise a circular array of signaling contacts each corresponding to a respective position of the on-load tap changer or the like. The signaling contacts are engaged by a centrally rotatable signaling contact lever that is connected with the on-load tap changer or more accurately with the motor drive of the on-load tap changer. In this manner the signaling-contact lever is moved with each change in operational position of the on-load tap changer, that is on switching from one winding tap to another, is only moved through an angle that corresponds to the spacing between two adjacent signaling contacts. As a result of the continuous movement of the signaling contact lever there is a very slow contact separation that depending on the switching operation can take several seconds. Such a position-signaling apparatus is thus not suitable when the signaling contacts are fed with a direct-current circuit or are required to transmit high currents.

German 1,812,609 shows a more developed position-signaling apparatus wherein in order to increase the switching capacity each individual contact has its own snap switch. This solution is however very expensive.

In order to simplify the system of German 2,108,013 a position-signaling apparatus is provided where there is only one such snap switch arranged in the circuit instead of the many snap switch and it is actuated by means of a cam disk that is coupled via a transmission with the signaling contact lever. Even this arrangement is somewhat expensive as two separate rotations must be created: on the one hand for the actual movement of the signaling contact lever from one signaling contact to the next, also with n possible positions through an angle of (360/n)°; on the other hand the movement of the cam disk that must for each switching turn through an angle of 360°, that is through a complete revolution.

For further simplification it is known from German patent 2,947,343 to mount the one provided snap switches for the position-signaling apparatus on the rotatable signaling contact arm. Actuation of the snap switch is effected by a concentric cam formation that extends in a circle around the signaling contact.

This arrangement has the disadvantage that the movable signaling contact cannot be made as a simple bridge since, as described, it carries the snap switch, and a series connection between the signaling contact, snap switch, and signaling contact to the contact arm is required. In addition the electrical connections to the snap switch complicate this arrangement since the snap switch orbits with the signaling contact lever, is therefore not stationary. In addition this known arrangement cannot be made as a printed circuit.

In general these known position-signaling apparatus are to complicated either in their actual structure on in their manufacture.

OBJECT OF THE INVENTION

It is an object of the invention to provide such a position-signaling apparatus that only has a single snap switch that is however simple in operation and particular easy to manufacture.

SUMMARY OF THE INVENTION

These objects are achieved according to the invention by a position-signaling apparatus used in combination with a tap changer or movable-core coil having a motor drive with a shaft rotatable about and extending along an axis. The apparatus has a support plate, an annular array of separate signaling contacts on the plate centered on the axis, and a cam disk juxtaposed with the plate, rotationally fixed with the shaft, and having an edge formed with a plurality of bumps. A contact arm mounted on the cam disk is engageable with the signaling contacts so that as the cam disk is rotated by the shaft the contact arm contacts succeeding signaling contacts. A switch mounted adjacent the cam edge is connected to the contact arm and has a cam follower engaging the bumps of the cam edge for opening and closing the switch synchronously as the contact arm moves between signaling contacts.

A particularly advantageous feature of the invention is that it is of simple construction and that it is very easy to assembly the entire apparatus.

BRIEF DESCRIPTION OF THE DRAWING

The invention is more clearly described in the following by way of example with reference to the drawings.

SPECIFIC DESCRIPTION

Figure 1:
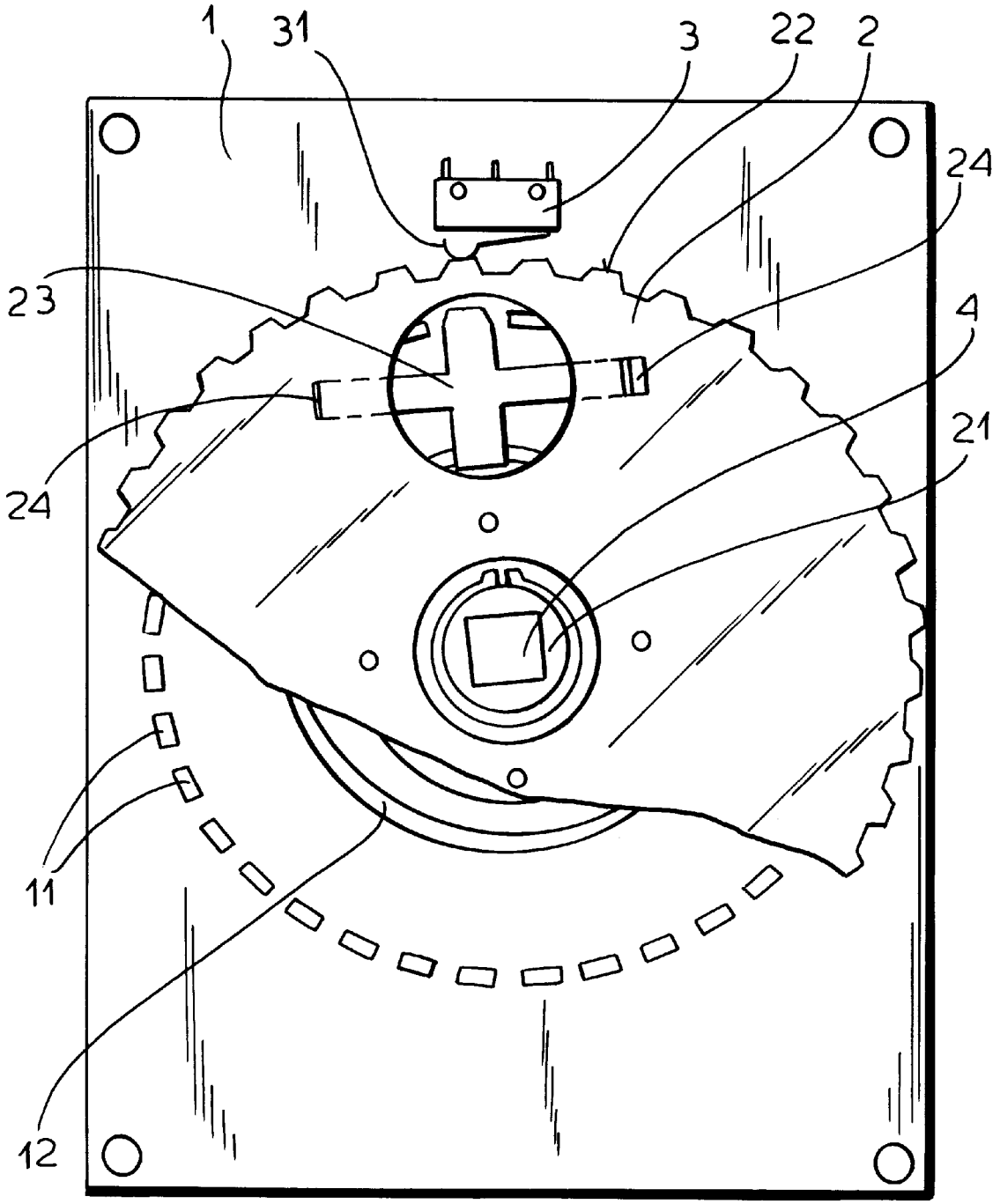
FIG. 1 shows a first arrangement according to the invention from above.
Figure 2:
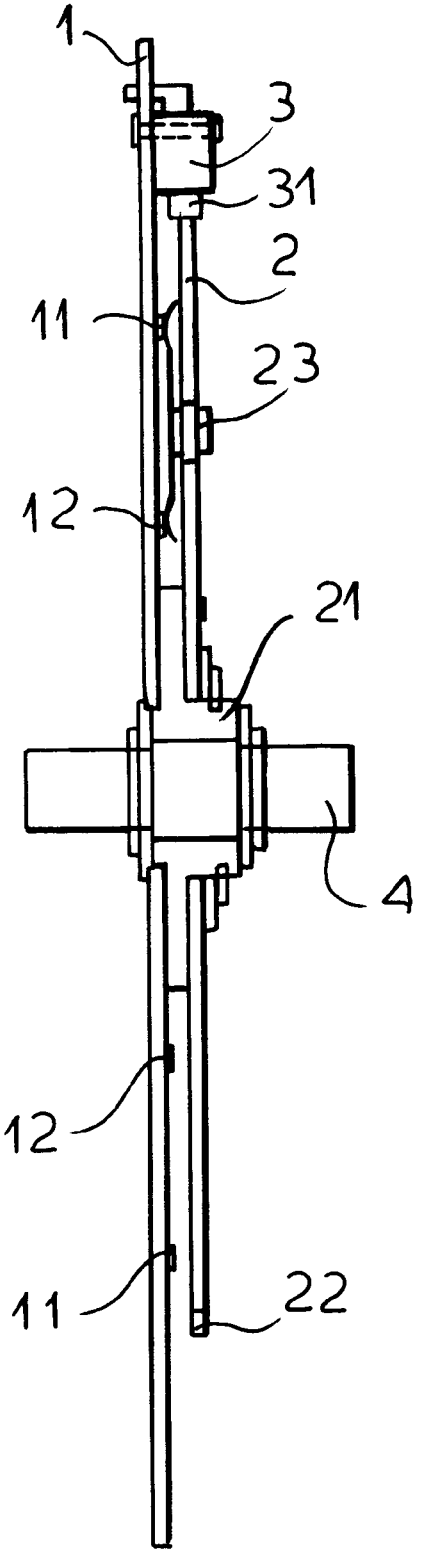
FIG. 2 shows this first embodiment from the side.

The embodiment shown in FIGS. 1 and 2 of a position-signaling apparatus according to the invention has a plate 1. This plate 1 in turn carries a circular array of mutually insulated signaling contacts 11. It further has concentric thereto a continuous circular output contact ring 12. The signaling contacts 11 and the output contact ring 12 can be made of separate contact pieces or strips, in particular it is advantageous when the plate 1 is formed as a printed-circuit board and the signaling contacts 11 and the output contact ring 12 are formed as through connected conductive strips on the upper side of this circuit board.

Outside the contact paths the plate 1 carries a snap switch 3 that has an actuating roller 31. A microswitch can be used as this snap switch. The electrical contacts of this snap switch 3 as well as conductive strips connected to the individual signaling contacts and the output contact ring on the back face of the plate are not shown in the drawing.

The position-signaling arrangement according to the invention further comprises a cam disk 2 that is journaled on and rotatable at a slight spacing parallel to the plate 1. To this end the cam disk 2 has a bearing 21 that is fixed centrally in the plate 1 at the center of the signaling contacts 11 and output contact ring 11. The edge of the disk 1 has bumps 22 that act on the actuating roller 31 of the snap switch 3. The cam disk 2 has on its side turned toward the plate 1 a conductive contact bridge 23 that at one end has a tongue-like projection which rides on the signaling contacts 11 and whose other free end is in continuous contact with the output contact ring 12, that is riding on it. The contact bridge 23 can be mounted particularly easily in that it is formed with projections whose free ends engage in holes 24 formed in the cam disk 2. With this arrangement rotation of the cam disk different individual contacts 11 are connected one after the other with the output contact ring 12. Simultaneously the edge bumps 22 actuate the snap switch 3 connected in the electrical circuit as its roller rides on the bumps 22. The cam disk 2 is connected centrally via a drive shaft 34 with the motor drive of the respective on-load tap changer.

This arrangement functions as follows:

The on-load tap changer is moved by the respective motor drive from one step to the next step, that is from one coil tap to the adjacent coil tap. The drive shaft 4 and with it the cam disk 2 rotate. The conductive contact bridge 23 which up to this time forms an electrical contact between the fixed signaling contact that corresponds to the previous step position and the output contact ring, starts to leave this signalling contact and moves according to rotation direction toward one of the flanking signaling contacts. Simultaneously the actuating roller 31 rides up on a bump 22 and the snap switch 3 is actuated to open the circuit before the contact bridge completely leaves the previous signaling contact. The snap witch 3 which is in the circuit thus opens the electrical circuit before there is actual mechanical separation from the signaling contact so that there is no arcing or the like at the contact. Thus the actual contact opening takes place with no load. on further rotation the contact bridge 23 reaches the next signaling contact and forms an electrical contact between same and the output contact ring 12. Subsequently the actuating roller 31 moves into a notch between bumps 22 and the snap switch again closes the circuit.

In order to guarantee this operation, it is necessary to accurately dimension the angular lengths of the individual contacts 11 and the relative spacings, as well as the contact bridge and the bumps 22. The switching sequences depend from these dimensions. Thus unlike the above-described switching sequence it is possible for the snap switch 3 to close the circuit before the conductive contact bridge 23 has reached the next signaling contact. In general the drive shaft 4 and thus the cam disk 2 move with each switching of the on-load tap changer through an angle of (360/n)°, where n is the number of possible steps, that is the number of signal contacts.

Figure 3:
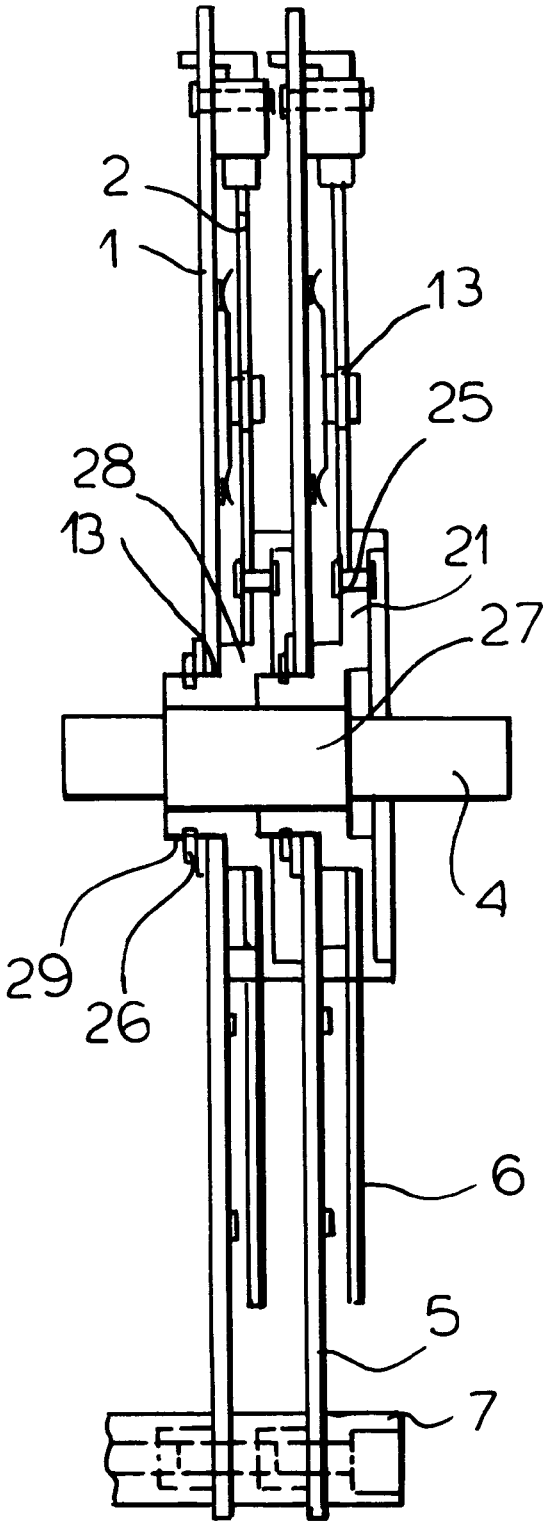
FIG. 3 shows a second arrangement according to the invention from the side.

FIG. 3 shows a second embodiment of the invention. In it the bearing 21 is fixed by a mounting element 25 to the cam disk 2 and has a central bushing 27 whose inner surface is complementary to the outer surface of the drive shaft 4. The plate 1 has a bore 13 whose diameter is somewhat larger than that of the bearing 21 so that it can project through and rotate freely. The plate 1 is axially fixed on the bushing 27 by engagement in one direction with a large-diameter ridge 28 and on the other side with an after-mounted snap ring 26 secured in a groove 29 of the bearing 21. This axially fixes the bearing 21 and disk 2 together while allowing them to rotate freely on the plate 1.

This embodiment has several advantages. First the entire assembly of the cam disk and its bearing can be preassembled and second this assembly need merely be pushed through the hole 13 in the plate 1 and secured on the other side with the snap ring 26. Another advantage is that the actual shaft 4 which transmits the rotation from the drive can be subsequently inserted through the sleeve 27. Thus with appropriate formation one can obtain a solid connection in the known manner.

It is also possible to provided the described position-signaling arrangement in several planes one above the other in identical systems for example for multiphase arrangements. FIG. 3 shows such an arrangement in two planes, some details being left out of the drawing. it is to be recognized that a second plate 5 and a second cam disk are provided that form an identical arrangement according to the invention. Fixing and mounting the individual assemblies is the job of spacer elements 7, while synchronous actuation of both cam disks 2 and 6 is effected by the drive shaft 4 extending through the entire assembly.

What is claimed is:

1. In combination with a tap changer or movable-core coil having a motor drive with a shaft rotatable about and extending along an axis, a position-signaling apparatus comprising:

a support plate;

an annular array of separate signaling contacts on the plate centered on the axis;

a cam disk juxtaposed with the plate, rotationally fixed with the shaft, and having an edge formed with a plurality of bumps;

a contact arm mounted on the cam disk, independently of the shaft and engageable with the signaling contacts, whereby as the cam disk is rotated by the shaft the contact arm contacts succeeding signaling contacts;

a switch mounted adjacent the cam edge and connected to the contact arm; and cam-follower means on the switch engaging the bumps of the cam edge for opening and closing the switch synchronously as the contact arm moves between signaling contacts.

2. The position-signaling apparatus defined in claim 1 wherein the cam-follower means is a roller riding on the cam edge.

3. The position-signaling apparatus defined in claim 1, further comprising an output conductor ring on the plate coaxial with the signaling-contact array, the arm having an end riding continuously on the output ring and an opposite end engageable with the signaling contacts, whereby as the cam disk is rotated by the shaft the contact arm connects succeeding signaling contacts with the output ring.

4. The position-signaling apparatus defined in claim 1 wherein the cam disk is dielectric and the contact arm is a bridge contact mounted on the cam disk.

5. The position-signaling apparatus defined in claim 4 wherein the cam disk has mounting holes and the bridge contact has projections engaged in the holes.

6. The position-signaling apparatus defined in claim 1 wherein the switch is mounted on the plate.

7. The position-signaling apparatus defined in claim 1 wherein the plate is a printed-circuit board and the signaling contacts are printed on it.

8. The position-signaling apparatus defined in claim 1 wherein the cam disk is provided with a bearing carrying the plate.

9. The position-signaling apparatus defined in claim 1 wherein the plate and disk are parallel to each other and axially fixed relative to each other.

10. The position-signaling apparatus defined in claim 1, further comprising a second such apparatus carried on the shaft.

* * * * *